United States Patent [19]

Mallory, Jr.

[11] 4,141,331

[45] Feb. 27, 1979

[54] BREAKERLESS CAPACITIVE DISCHARGE IGNITION SYSTEM

[75] Inventor: Marion Mallory, Jr., Carson City, Nev.

[73] Assignee: W. R. Grace & Co., New York, N.Y.

[21] Appl. No.: 516,494

[22] Filed: Oct. 21, 1974

Related U.S. Application Data

[63] Continuation-in-part of Ser. No. 282,654, Aug. 22, 1972, Pat. No. 3,842,817.

[51] Int. Cl.[2] ..... F02P 1/00

[52] U.S. Cl. ..... 123/148 CC

[58] Field of Search ..... 123/148 AC, 148 CC, 123/148 E, 149 R, 149 C, 149 D; 310/70 A, 70 R

[56] References Cited

U.S. PATENT DOCUMENTS

| | | | |
|---|---|---|---|
| Re. 27,704 | 7/1973 | Charmichael et al. | 123/148 CC |
| 3,367,314 | 2/1968 | Hirosawa et al. | 123/148 CC |
| 3,478,249 | 11/1969 | Jukes | 123/148 E |
| 3,584,929 | 6/1971 | Schuette | 123/148 E |
| 3,732,483 | 5/1973 | Katsumato | 123/149 C |
| 3,809,043 | 5/1974 | Nagasawa | 123/148 E |
| 3,835,830 | 9/1974 | Shepard | 123/149 C |
| 3,842,817 | 10/1974 | Mallory | 123/149 C |

*Primary Examiner*—Ronald B. Cox

*Attorney, Agent, or Firm*—William Kovensky

[57] ABSTRACT

A breakerless capacitive discharge ignition system is provided for use in connection with a magneto power supply. A time delay circuit is provided to delay discharge of the capacitor until it is completely charged by a pulse of electrical energy being emitted from the magneto.

1 Claim, 2 Drawing Figures

BREAKERLESS CAPACITIVE DISCHARGE IGNITION SYSTEM

REFERENCE TO COPENDING APPLICATIONS

Figure 2:
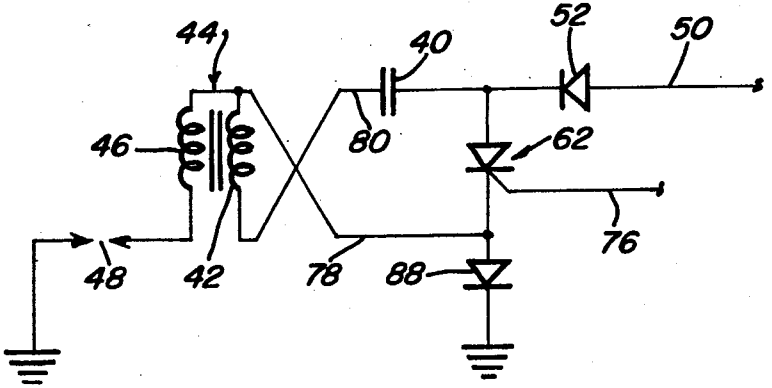

This application is a continuation-in-part of U.S. patent application Ser. No. 282,654, filed Aug. 22, 1972, now U.S. Pat. No. 3,842,817, issued Oct. 22, 1974.

BACKGROUND OF THE INVENTION

Magneto ignition systems for internal combustion engines are widely used for motorcycles and snowmobiles. The magneto ignition systems in use are generally adapted to operate in conventional fashion. The magneto, which is a type of electrical generator, induces a voltage in a primary winding which is inductively coupled to a secondary winding to form a step-up transformer. Initially, current is permitted to flow in the primary winding to build up an electrical field thereabout. When the field reaches a certain pre-selected value, the circuit through the primary winding is suddenly opened, resulting in the field collapsing and inducing a sparking voltage in the secondary winding.

More recently, capacitive discharge ignition systems have come into favor. In a capacitive discharge system, a capacitor is charged to a pre-selected voltage. The capacitor is then suddenly discharged through the primary winding of an output coil. A sparking voltage is induced in the secondary winding of the coil upon the build-up of the field about the primary winding as opposed to being induced upon the collapse of the field in the primary winding. One advantage of a capacitive discharge system is that the sparking voltage is obtained more rapidly than is the case in conventional ignition systems. This is advantageous in that by reaching a peak voltage sooner, there is more chance that the spark plug will fire because there is not sufficient time for leakage and dissipation of electrical energy about a fouled spark plug. Additional advantages occur in the permissible range of timing which is realized with a capacitive discharge system.

The present invention utilizes the primary circuit of a magneto (without the customary points and capacitor) as the power supply in a capacitive discharge ignition system.

SUMMARY OF THE INVENTION

A breakerless capacitive discharge ignition system for an internal combustion engine is provided. A capacitor is connected to the primary winding of a magneto and is charged thereby. An ignition coil having a primary winding and a secondary winding is provided. The primary winding of the coil is connected between ground and the capacitor. A controlled rectifier is connected between the capacitor and ground from a point on the opposite side of the capacitor from the connection of the capacitor to the primary winding of the coil. The controlled rectifier, capacitor and primary winding of the coil form a series circuit. A time delay circuit is connected between the magneto primary winding and the gate electrode of the controlled rectifer. The time delay circuit provides a signal to the gate electrode to trigger the controlled rectifier into a conducting state upon a pulse of electrical energy of a selected polarity being emitted from the magneto to charge the capacitor. The signal is delayed for a sufficient time to permit complete charging of the capacitor.

THE DRAWING

Figure 1:
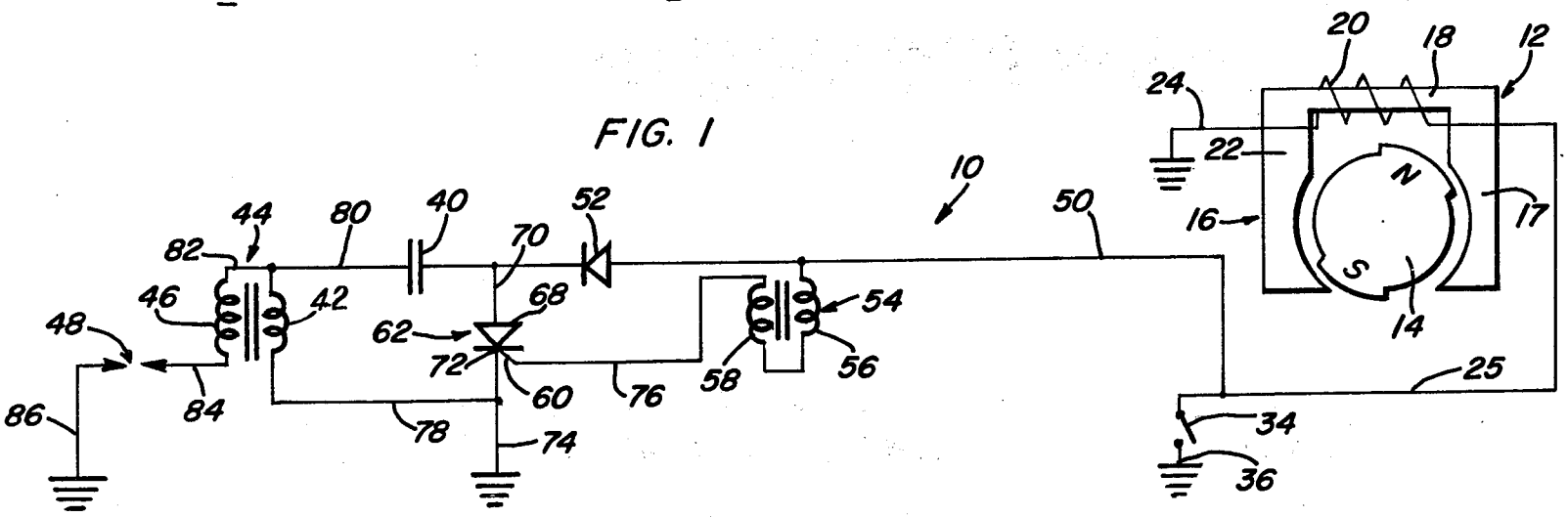

FIG. 1 is an electrical schematic view of one embodiment of a capacitive discharge ignition system in accordance with the present invention; and FIG. 2 is a partial electrical schematic view of a modified version of the right hand portion of the circuitry shown in FIG. 1.

Referring to FIG. 1, it will be noted that the capacitive discharge ignition system 10 is adapted for use in connection with a magneto 12 power supply. A magneto is a generator having a permanent magnet 14 supplying the magnetic field. The magnet 14 is a rotating member. A stationary, generally horseshoe-shaped armature 16 which surrounds the magnet 14 is fabricated of soft steel laminations. It is possible to provide a magneto with the stationary member being a magnet and having an armature of soft iron as the rotating member. A two-pole magnet has been illustrated. However, a four or six-pole rotor may be used as desired.

In the magneto 12, the north and south are the poles of a permanent-magnet rotating field. In the position shown, lines of flux pass from the north pole through the frame laminations 17 of the armature 16 and the core 18 of winding 20, thence through the frame lamination 22 and back to the south pole. The internal magnetic circuit is completed within the field from the south pole to the north pole. Rotation of the rotor results in inducing an emf in the winding 20 which varies from a maximum value to zero and then from zero to a maximum value with a reversal of direction every 180°. The emf induced in the winding 20 is thus of a sinusoidal nature.

The secondary winding usually provided on core 18 has not been shown in FIG. 1 because this winding is not used in accordance with the circuitry of the present invention. Also, the points and capacitor usually employed in a conventional magneto ignition are not used, since the present ignition system uses the energy created by the collapsing field of the winding 20 to charge a capacitor 40. This capacitor is subsequently discharged rapidly through the primary winding 42 of a step-up output coil 44 to induce a high voltage in the secondary winding 46 for the purpose of providing a voltage at spark plug 48 sufficient for sparking purposes. In the coil 44, the high voltage in the secondary winding is created by the sudden surge of current upon discharge of capacitor 40 through the primary winding 42 which results in a rapidly developing field around the primary as opposed to the usual ignition system as above-described wherein the high voltage in the secondary is induced as a consequence of a collapsing field in a primary winding.

It is possible to obtain high voltage in a shorter time period by use of a capacitive discharge system as compared to a conventional system. Such is desirable from the standpoint of operation of spark plugs as, for example, it will cause the firing of even fouled spark plugs as a consequence of providing the high voltage in a short period of time to thus prevent leakage of electrical energy around the surfaces of the plugs which dissipates energy which otherwise would be available for sparking purposes. The circuit of FIG. 1 will work in connection with a system which receives both positive and negative pulses. As the magneto 12 rotates, sinusoidal output is achieved without the use of points. However, the present system of FIG. 1 is not designed to be used where only the positive pulse is available. The use of the term positive and negative is relative, it being appreciated that the circuit could be adapted for the use of opposite polarity by substitution of appropriate circuit components.

A lead 50 is connected to lead 25 at a point between the switch 34 and winding 20. The lead 50 extends to the capacitor 40. A diode 52 is provided in lead 50 before the capacitor 40. The function of diode 52 is to rectify the output of the winding 20 permitting only positive pulses to pass to the capacitor 40. As will be appreciated, if it were decided to have negative pulses only pass to the capacitor 40, the diode 52 could be reversed. The positive pulses which pass diode 52 charge the capacitor 40 to the desired level. However, it is not desired to have the capacitor 40 discharge to primary winding 42 until such time as the complete charge is present thereon. Therefore, a time delay circuit is provided. A small transformer 54 and controlled rectifier 62 are provided for this purpose. The primary winding 56 of the transformer is connected in series with the secondary winding 58. The secondary winding 58 of the transformer is connected to the gate 60 of controlled rectifier 62 via lead 76.

The controlled rectifier 62 is a solid state four-layer NPNP semi-conductor. In its normal state, the controlled rectifier acts as an open circuit that will not pass current. When an appropriate voltage or current pulse is applied to the gate electrode 60, it will cause the controlled rectifier to be forward biased to permit current flow. Application of the proper polarity voltage to the controlled rectifier will allow electrons to flow from the cathode 68 to anode 72. Reversal of the voltage polarity will result in the controlled rectifier being an open circuit. With the controlled rectifier conducting, application of reverse polarity to the gate electrode 60 will place the controlled rectifier in its original state of an open circuit. Thus, the controlled rectifier in the present circuit acts as a switching diode, capable of being switched on or off by appropriate pulses at the gate electrode 60.

As will be noted, the cathode 68 of the controlled rectifier is connected to lead 50 via lead 70 at a point between diode 52 and capacitor 40. The anode 72 is connected to ground via lead 74. As previously mentioned, the gate 60 is connected to one side of secondary winding 58 via lead 76. One side of primary winding 42 is connected to ground via lead 78. One side of the capacitor 40 is connected to the other side of winding 42 via lead 80. The secondary winding 46 of the coil 44 has a common connection via lead 82 to one side of the primary winding 42. The other side of winding 46 is connected to spark plug 48 via lead 84. The other side of the spark plug is connected to ground via lead 86.

In operation of the circuit, with the engine running, the emf induced in winding 20 causes current to flow through lead 50, assuming a positive pulse, via diode 52 to charge capacitor 40. At the same time, a portion of the current flows through a primary winding 56 of the small transformer 54. This results in a developing field about winding 56, which induces an emf in secondary winding 58. When this induced voltage is of sufficient value, it will pulse the gate 60 of controlled rectifier 62 to cause conduction of the controlled rectifier. The capacitor 40 will then have a complete circuit to ground and will discharge through the primary winding 42 of coil 44 thus inducing a high voltage in secondary winding 46 to cause sparking of spark plug 48.

The small time delay caused as a result of the time required for the rising field in primary winding 56 of transformer 54 to induce the necessary voltage in secondary winding 58 is sufficient to permit capacitor 40 to assume its full charge before being discharged. The controlled rectifier 62 is thus not triggered to conduct until such time as the proper charge has been placed on capacitor 40. The automatic nature of operation of transformer 54 is of great value in that its operation is inherent in its original design and therefore does not need adjustment during use of the ignition system.

As will be appreciated, the circuitry illustrated in FIG. 1 could be modified to permit utilization of the opposite sign pulse from the magneto 12. However, as a matter of convenience and commercial practicability, the circuit of FIG. 2 has been developed to permit usage of the circuit of FIG. 1 for negative pulses with minor modifications only. The only changes in the FIG. 2 circuit from that of FIG. 1 consists of providing a diode 88 in lead 74 beyond the connecting point of lead 78 and in switching the connections of leads 78 and 80 to the opposite ends of primary winding 42. In the system shown in FIG. 2, it is desired to have an induced emf in secondary winding 46 of opposite polarity from that which would be attained in the FIG. 1 circuit. Consequently, reversing the connections of the primary winding 42 will result in reversing the polarity of the field developed about winding 42 to thus provide the induced emf of opposite polarity in winding 46. The diode 88 is provided as a protective device for the coil 44 which has been hooked up in a manner opposite from that originally intended.

While the invention has been shown by particular example, there is no intent to limit the extent of concept except as set forth in the following claims.

What I claim as my invention is:

1. A magneto driven breakerless capacitive discharge ignition system including an ignition coil for at least one spark plug to be energised by said system; the combination comprising a series circuit of said magneto, rectifying means, the capacitor, and the primary side of said ignition coil, a controlled rectifier connected to said series circuit between said rectifying means and said capacitor to control the discharging of said capacitor and a parallel time delay circuit connected to said series circuit between said magneto and said rectifying means, said time delay circuit comprising a transformer with its two sides connected together and in series with the gate of said controlled rectifier; whereby the energy produced by said magneto simultaneously charges said capacitor and builds up in said time delay transformer until said time delay transformer is energised sufficiently to permit operation of the gate of said controlled rectifier to thereby cause said capacitor to discharge.

* * * * *